US006651983B1

(12) United States Patent
Chobanian

(10) Patent No.: US 6,651,983 B1
(45) Date of Patent: Nov. 25, 2003

(54) POKER GAME

(76) Inventor: Vasil Chobanian, 830 E. Acacia #E, Glendale, CA (US) 91205

( * ) Notice: Subject to any disclaimer, the term of this patent is extended or adjusted under 35 U.S.C. 154(b) by 0 days.

(21) Appl. No.: 10/087,885

(22) Filed: Mar. 4, 2002

(51) Int. Cl.[7] ..... A63F 1/00
(52) U.S. Cl. ..... 273/292; 273/274; 463/13
(58) Field of Search ..... 273/292, 274; 463/13

(56) References Cited

U.S. PATENT DOCUMENTS 5,752,702 A * 5/1998 McDoniel ..... 273/292
6,379,245 B2 * 4/2002 De Keller ..... 463/13

* cited by examiner

*Primary Examiner*—Benjamin H. Layno
*Assistant Examiner*—Vishu Mendiratta
(74) *Attorney, Agent, or Firm*—Erik M. Arnhem

(57) ABSTRACT

A poker card game, played with a conventional deck of cards, provides each player with three down cards. Additionally, there are four exposed community cards that any player can combine with his three cards to effectively form a seven card poker hand. The player having the highest five card poker hand is the winner.

1 Claim, 3 Drawing Sheets

POKER GAME

FIELD OF THE INVENTION

This invention relates to a poker card game played with conventional playing cards, i.e. a single deck of cards that includes four suits (spades, hearts, clubs and diamonds) totaling fifty two cards per deck. The invention concerns the manner in which the cards are dealt to the players, and the way in which the players use the cards to form a winning poker hand.

BACKGROUND AND SUMMARY OF THE INVENTION

There is in existence a poker card game known as Texas Hold Em. The game is played so that each player has the use of seven cards in order to form a five card poker hand. The player having the highest poker hand is the game winner. Hands are ranked in standard poker fashion, i.e. royal flush, straight flush, four of a kind, full house, flush, straight, three of a kind, two pair, one pair, and high card, in descending order.

In Texas Hold Em each player receives two cards face down. Additionally, there are five community cards dealt face up. The term "community card" refers to a card that is exposed (face up) and available for use by any of the players in order to form a poker hand. Each player is enabled to use seven cards (i.e. the two concealed cards that he holds, plus the five community cards that are available to each player).

In Texas Hold Em the cards are dealt sequentially so that each player initially receives his two cards face down, after which the five community cards are dealt face up. Rounds of betting occur at certain times during the course of the deal, usually after the two face down cards have been dealt, then after the third community card has been dealt, then after the fourth community card has been dealt, and finally after the fifth community card has been dealt. Thus, there are four rounds of betting (in addition to an ante prior to the cards being dealt.

One problem with Texas Hold Em is that the winning hand is usually a low value poker hand, typically two pair when there are five players. Should one player have a high hand at an early stage in the deal (e.g., after five cards have been dealt) he can bet very high to force the other players out of the game.

Another problem with Texas Hold Em is that each player has to guess only two cards for each opponent, i.e., the two concealed cards held by each player. One raise in the betting can often indicate that the person has a concealed pair, when the winning hand is most likely a low value poker hand, one raise will often drive the other players out of the game.

The present invention concerns a poker game that is in many respects similar to Texas Hold Em, but differs therefrom in that the game is designed to produce higher value winning hands. Typically the winning hand will be a straight or three of a kind when there are five players. This contrasts with two pair winning hand that is a common out-come in Texas Hold Em.

The game of the present invention involves the use of seven cards by each player to form a five card poker hand. In the deal, each player initially receives two cards face down. Then four community cards are dealt face up (each player has the use of these community cards). Lastly, each player receives a third card face down.

Betting occurs during the course of the deal, e.g. a first round of betting after the players have received their two face down cards, a second round of betting after the third community card, a third round of betting after the fourth community card, and a final round of betting after each player has received his final (third) card.

In the present card game each player receives three cards face down, rather than two cards as in Texas Hold Em. In the present game there are four community cards, rather than five community cards as in Texas Hold Em. These differences tend to produce higher winning hands so that players tend to stay in each game for a longer period of time, usually until the last round of betting.

A principal feature of the invention is the employment of three hidden cards in each player's hand, which makes it more difficult for the players to predict the winning hand. Every player has a winning chance, which makes the game more interesting.

Specific features of the invention will be apparent from the attached drawings and description of a way that the game is played according to the invention.

DESCRIPTION OF A PREFERRED EMBODIMENT OF THE INVENTION

Figure 1:
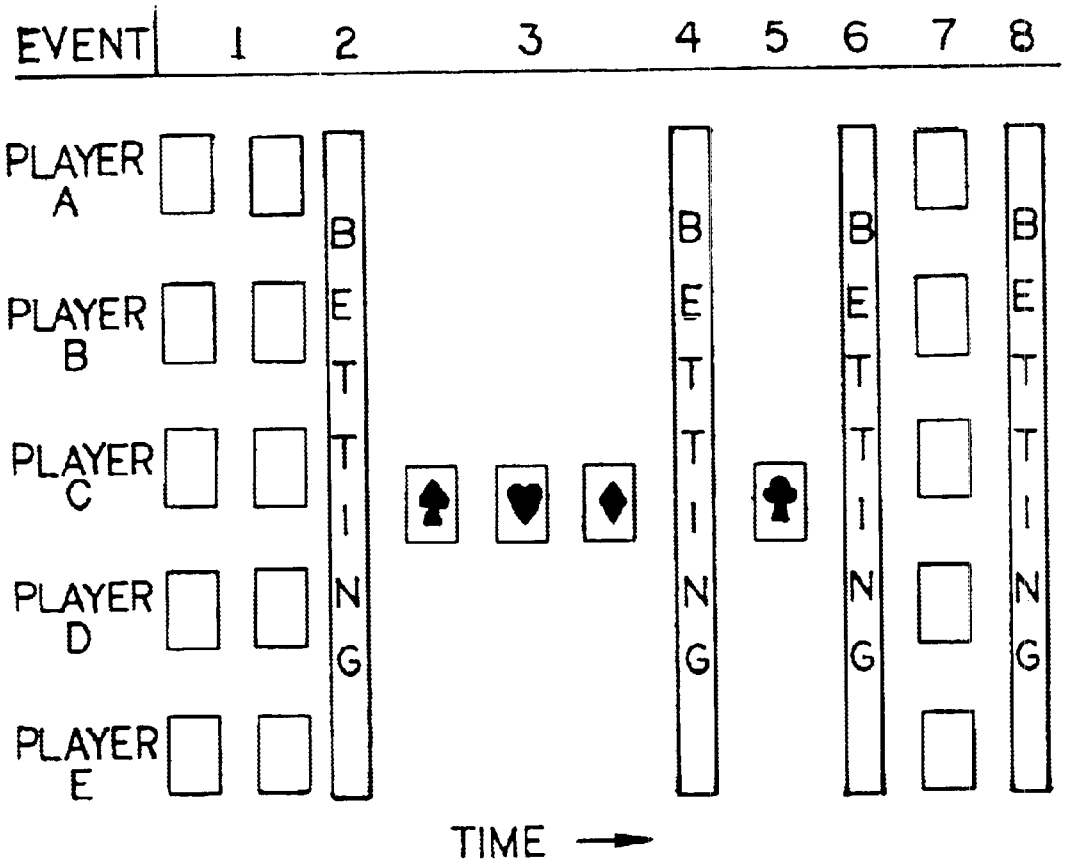
FIG. 1 is a diagram showing a sequence of card playing and betting according to the invention.
Figure 2:
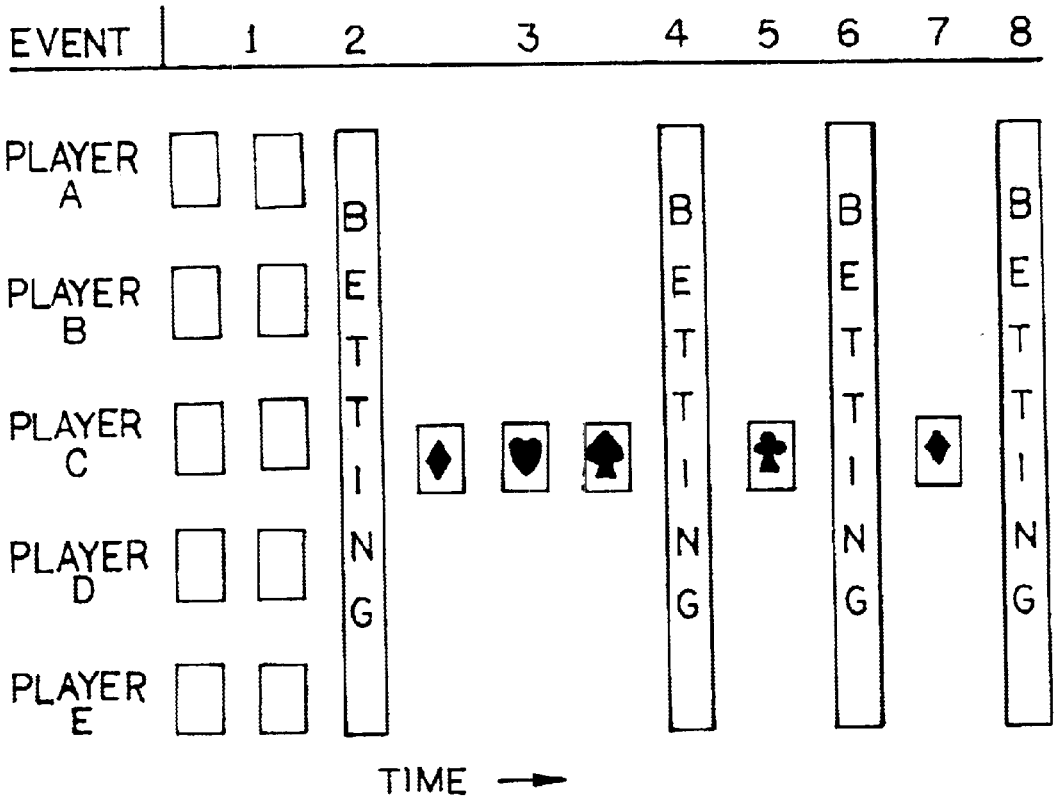
FIG. 2 (PRIOR ART)
FIG. 2 is a diagram of the type shown in FIG. 1, except that it relates to a prior art game known as Texas Hold Em.

Referring to FIG. 1, there is shown a diagram that explains how the game of the present invention is played. The diagrams shows 8 different events taking place sequentially during the course of the game. The diagram presupposes five players, although the game can be played by different numbers of players, up to about nine players.

The game is played with a single deck of cards containing four suits of thirteen cards per suit, making a total of fifty two cards. The deck is conventional poker deck (or bridge deck). The aim of each player is to achieve a winning poker hand, using three concealed cards held by each player and four community cards available to all players.

Referring to FIG. 1, prior to event No. 1 the players ante an agreed number of chips (tokens) to form a pot, i.e. the prize for the winning hand. Event No. 1 involves dealing two cards face down to each player. Each player is permitted to look at his two cards, but not the cards of the other players.

Event No. 2 involves a first round of betting. The players bet, based on the first two cards dealt to each player. Any player can drop out of the game at any time, e.g. after the first two cards have been dealt to each player, but prior to the first round of betting.

Event No. 3 involves the dealing of three community cards face up. In the diagram the three face up cards are illustratively depicted as a spade, heart and diamond. The cards can in practice be any card in the deck, i.e. the three topmost cards in the deck.

A community card can be used by any player in order to form a five card poker hand. For example, if player A should hold two kings and one of the three community cards is a king, then player A has a hand value of three kings at that point in time.

Event No. 4 is a second round of betting. The players base their bets on their individual hands, plus the three community cards. Each player also takes into consideration the bets of the other players.

Event No. 5 is the dealing of a fourth community card. As with the previous three community cards, the fourth community card can be any card in the deck, i.e. the topmost card in the deck at the moment.

As shown in FIG. 1, the second round of betting (event No. 4) takes place after the first three community cards have been dealt, but prior to dealing the fourth community card. However, the second round of betting could occur at a different point in the game, e.g. immediately after the second community card has been dealt. Alternately, the betting round designated as event 4 could be omitted. In any case, the game involves the use of four community cards available to any of the players for forming individual five card poker hands.

Event No. 6 involves dealing each player one card face down. After event No. 6 each player still in the game has three concealed cards that only he can see. These three cards, together with the four community cards can be used to form individual five card poker hands. The highest poker hand is the game winner.

Event No 7 involves dealing each player one card face down. After event No. 7 each player still in the game has three concealed cards that only he can see. These three cards, together with the four community cards can be used to form individual five card poker hands. The highest poker hand is the game winner.

Event 8 is a final round of betting after which the hands of the players still in the game are exposed to describe the game winner.

The difference between the two games produce different winning hands. With the present invention the winning hand is, on average, three of a kind or a straight (assuming five players in the game), whereas in Texas Hold Em the winning hand is, on average, two pair. The game of the present invention is more interesting in that each player is able to stay in the game longer, with a better chance for relatively improving a poor or mediocre hand as the game progresses.

The fifth community card in Texas Hold Em makes one specific combination with the other four community cards. The five community cards collectively have the same potential combinability for each player's two down cards. In practice the five community cards tend to improve or combine with only one or two players' hands, so that the winning hand tends to be a relatively low value poker hand, typically two pair.

In the game of the present invention the third down card in each player's hand combines with the four community cards in a different fashion, so that the combination of each third down card and the four community cards achieves a different total strength for each player. Some of the player's last five cards will be stronger, as compared with the last five cards in Texas Hold Em.

Figure 3:
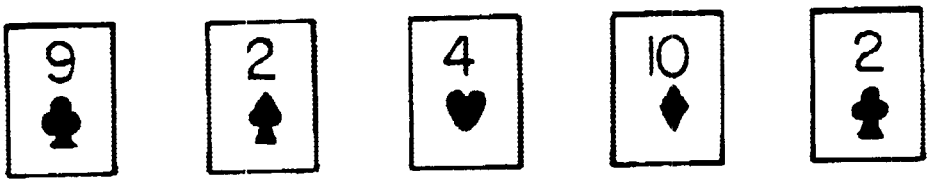
FIGS. 3 and 4 are diagrams illustrating certain features of the card games depicted by FIGS. 1 and 2.
Figure 4:
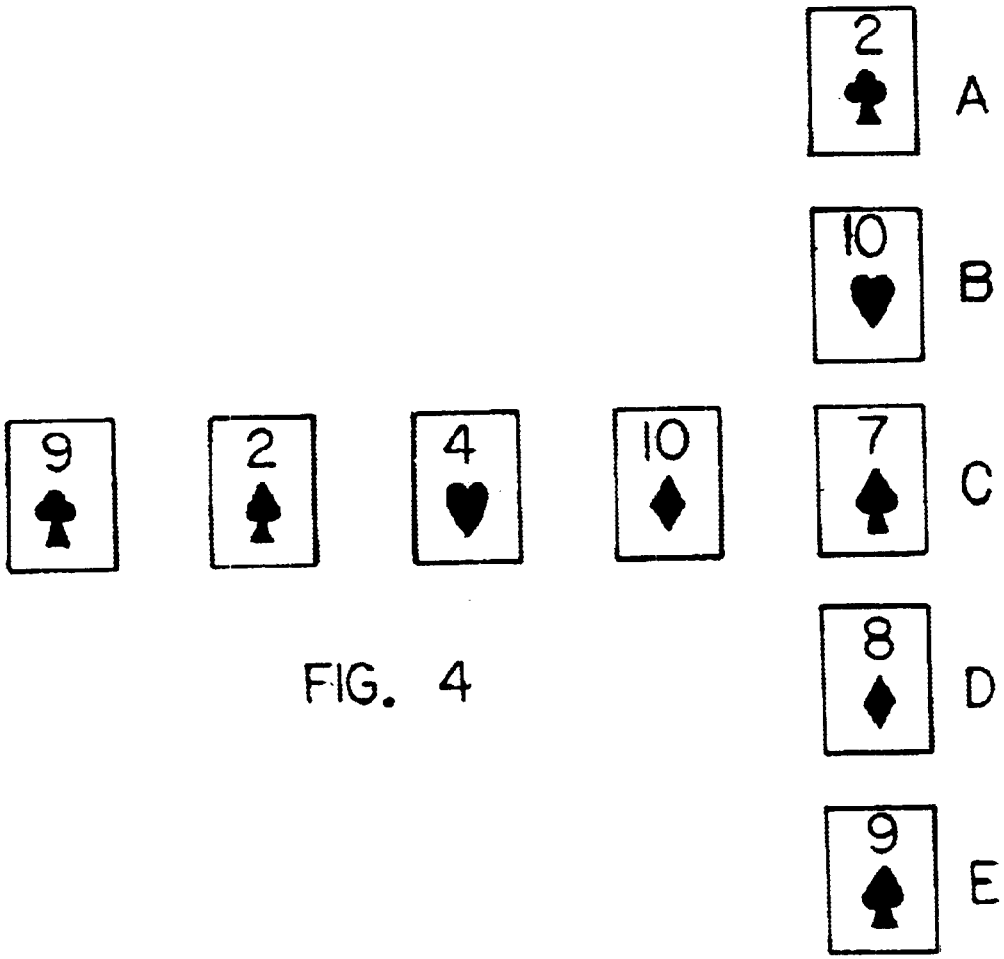

The above-described difference is illustrated in FIGS. 3 and 4. FIG. 3 shows a typical last five cards in Texas Hold Em; the two of clubs is the last community card. The strength of the last five cards is a pair of twos.

FIG. 4 shows possible combinations of the last five cards with the game of the present invention. The vertical row of cards represents the last card received by each player, e.g., players A,B,C,D and E in the FIG. 1 scenario.

In FIG. 4 the four community cards are the same as those shown in FIG. 3, for comparison purposes. For the last five cards in the FIG. 4 illustration player A card strength is a pair of twos, player B card strength is a pair of tens, player C card strength is ten high, player D card strength is ten high, and player E card strength is a pair of nines.

It will be seen from a comparison of FIGS. 3 and 4 that some players in the present game have "last five card combinations" that potentially are stronger than the last "five card combinations" in Texas Hold Em. (due to the fact that the last card in the present game is variable rather than being the same for all players).

When the last five cards are combined with the first two down cards in each player's hand (event No. 1) the final winning poker hands will, on average, be higher in the present game.

Another factor that tends to make the present game less predictable and more interesting is the concealed nature of the final card (event No. 7). The players are less able to predict the cards in the opponents hands because each player has three concealed cards rather than two concealed cards.

It will be appreciated that the Poker Game could be played with minor variations, such as, for example, varying the timing of dealing the cards, but still substantially producing the same results, within the scope of my invention, as described.

What is claimed:

1. A poker card game played with conventional playing cards, comprising:

(a) first, dealing two cards face down to each player, (b) second, conducting a round of betting after the two cards have been dealt, (c) third, dealing three community cards face up, wherein each community card is usable by any player to form a five card poker hand, (d) fourth, conducting another round of betting after the third community card has been dealt;

(e) fifth, dealing one community card face up, (f) sixth, conducting another round of betting after said one community card has been dealt, (g) seventh, dealing one card face down to each player, (h) eighth, conducting a further round of betting, and (i) ninth, exposing the dealt cards to determine which player has the winning five card poker hand, wherein each hand comprises three cards dealt to a player plus the four community cards;

said steps (a) through (I) being conducted sequentially, beginning with steps (a) and concluding with step (i).

* * * * *